US010508855B2

(12) United States Patent
Yang et al.

(10) Patent No.: US 10,508,855 B2
(45) Date of Patent: Dec. 17, 2019

(54) REFRIGERATOR

(71) Applicants: HEFEI MIDEA REFRIGERATOR CO., LTD., Hefei (CN); MIDEA GROUP CO., LTD., Foshan (CN)

(72) Inventors: Wei Yang, Hefei (CN); Wei Zhang, Hefei (CN); Xiuhua Geng, Hefei (CN)

( * ) Notice: Subject to any disclaimer, the term of this patent is extended or adjusted under 35 U.S.C. 154(b) by 67 days.

(21) Appl. No.: 15/757,654

(22) PCT Filed: Sep. 11, 2015

(86) PCT No.: PCT/CN2015/089454
§ 371 (c)(1),
(2) Date: Mar. 6, 2018

(87) PCT Pub. No.: WO2017/035867
PCT Pub. Date: Mar. 9, 2017

(65) Prior Publication Data

US 2018/0245834 A1 Aug. 30, 2018

(30) Foreign Application Priority Data

Sep. 6, 2015 (CN) ..... 2015 2 0684164 U
Sep. 6, 2015 (CN) ..... 201510560960

(51) Int. Cl.
*F25D 11/02* (2006.01)
*F25D 17/06* (2006.01)
(Continued)

(52) U.S. Cl.
CPC ..... *F25D 11/02* (2013.01); *F25D 17/045* (2013.01); *F25D 17/06* (2013.01); *F25D 17/065* (2013.01);
(Continued)

(58) Field of Classification Search
CPC ..... F25D 11/02; F25D 17/045; F25D 17/06; F25D 17/065; F25D 23/003; F25D 2317/061; F25D 17/04
See application file for complete search history.

(56) References Cited

U.S. PATENT DOCUMENTS

2006/0168990 A1* 8/2006 Park ..... F25D 17/045 62/408
2010/0147003 A1* 6/2010 Ueda ..... A23B 4/066 62/314
2016/0091238 A1* 3/2016 Simpson ..... F25D 17/045 62/340

FOREIGN PATENT DOCUMENTS

CN 203224089 U 10/2013
CN 203771864 U 8/2014
(Continued)

OTHER PUBLICATIONS

CN First Office Action dated Dec. 30, 2016 in the corresponding Chinese application(application No. 201510560960.8).
(Continued)

*Primary Examiner* — Elizabeth J Martin
(74) *Attorney, Agent, or Firm* — Kilpatrick Townsend & Stockton

(57) ABSTRACT

An air-cooled refrigerator comprises: a housing, a freezer liner, a variable-temperature liner, a refrigerator liner, a foam layer, an embedded member, an electric damper, a freezer air outlet channel, a variable-temperature air inlet channel and a refrigeration air inlet channel. The space between the housing and the freezer liner, variable-temperature liner and refrigerator liner is filled with the foam layer. The electric damper is disposed above the embedded member and in the foam layer, and is provided with a cool air inlet, a first cool air outlet and a second cool air outlet thereon.

6 Claims, 3 Drawing Sheets

(51) Int. Cl.
*F25D 17/04* (2006.01)
*F25D 23/00* (2006.01)

(52) U.S. Cl.
CPC ..... *F25D 23/003* (2013.01); *F25D 2317/061* (2013.01)

(56) References Cited

FOREIGN PATENT DOCUMENTS

| | | | |
|---|---|---|---|
| CN | 104567180 | A | 4/2015 |
| CN | 205048849 | U | 2/2016 |

OTHER PUBLICATIONS

International Search Report dated May 27, 2016 in the corresponding Chinese application(application No. PCT/CN2015/089454).

* cited by examiner

REFRIGERATOR

CROSS-REFERENCE TO RELATED APPLICATION

This application is a national phase entry under 35 USC § 371 of International Application PCT/CN2015/089454, filed Sep. 11, 2015, which claims priority to and benefits of Chinese Patent Applications Serial No. 201520684164.0 and 201510560960.8, filed with the State Intellectual Property Office of P. R. China on Sep. 6, 2015, the entire contents of which are incorporated herein by reference.

FIELD

The present disclosure relates to a field of household appliances, and specifically to an air-cooled refrigerator.

BACKGROUND

An existing three-door air-cooled refrigerator includes a freezing compartment, a refrigerating compartment and a temperature-variable compartment. In the freezing compartment, there is provided with a dual electrical damper having two air outlets. Cold air in the freezing compartment enters the refrigerating compartment and the temperature-variable compartment correspondingly through the two air outlets of the dual electrical damper. However, the dual electrical damper in the freezing compartment has a defect of tending to be in a control failure.

SUMMARY

The present disclosure is made based on discoveries and acknowledges of the following facts and problems by inventors: a dual electrical damper of an existing three-door air-cooled refrigerator, i.e. an air-cooled refrigerator having a freezing compartment, a refrigerating compartment and a temperature-variable compartment, tends to be involved in a control failure, causing the refrigerating compartment and the temperature-variable compartment to be unable to perform refrigeration. It is found after in-depth research by the inventors that, because the dual electrical damper is mounted in the freezing compartment and temperature in the freezing compartment is relatively low, the dual electrical damper tends to frost and ice up, thereby leading the dual electrical damper to a control failure much easily.

The present disclosure seeks to solve one of the problems existing in the related art to at least some extent. For that reason, the present disclosure provides an air-cooled refrigerator, and an electrical damper of the air-cooled refrigerator doesn't tend to be involved in a control failure.

The air-cooled refrigerator according to embodiments of the present disclosure includes a housing; a freezing inner container, a temperature-variable inner container and a refrigerating inner container disposed in the housing at intervals in an up and down direction, in which a wall of the temperature-variable inner container is provided with a temperature-variable air inlet, a wall of the refrigerating inner container is provided with a refrigerating air inlet, and a wall of the freezing inner container is provided with an air outlet; a foaming layer filled in a space between the housing and the freezing inner container, the temperature-variable inner container and the refrigerating inner container; an embedded member disposed in the foaming layer; an electrical damper provided to the embedded member and located in the foaming layer, the electrical damper being provided with a cold air inlet and a first cold air outlet and a second cold air outlet in communication with the cold air inlet; a freezing air-outlet passage having a first end connected with the air outlet and a second end connected with the cold air inlet; and a temperature-variable air-inlet passage and a refrigerating air-inlet passage, the temperature-variable air-inlet passage having a first end connected with the first cold air outlet and a second end connected with the temperature-variable air inlet, the refrigerating air-inlet passage having a first end connected with the second cold air outlet and a second end connected with the refrigerating air inlet.

The electrical damper of the air-cooled refrigerator according to embodiments of the present disclosure doesn't intend to be involved in the control failure.

In addition, the air-cooled refrigerator according to the above-mentioned embodiments of the present disclosure can also have the following additional technical features.

According to an embodiment of the present disclosure, the embedded member and the electrical damper are opposite to the temperature-variable inner container or the refrigerating inner container in a horizontal direction.

According to an embodiment of the present disclosure, the embedded member has a mounting cavity, the mounting cavity having an open end, and at least a part of the electrical damper is disposed in the mounting cavity.

According to an embodiment of the present disclosure, a wall of the mounting cavity is provided with a horizontal groove and a vertical groove, and an outer surface of the electrical damper is provided with a horizontal convex rib and a vertical convex rib, in which at least a part of the horizontal convex rib is disposed in the horizontal groove, and at least a part of the vertical convex rib is disposed in the vertical groove.

According to an embodiment of the present disclosure, a shape of the horizontal convex rib is adapted to a shape of the horizontal groove, and a shape of the vertical convex rib is adapted to a shape of the vertical groove.

According to an embodiment of the present disclosure, the horizontal groove includes a first sub-groove disposed to a first side wall of the mounting cavity, a second sub-groove disposed to a second side wall of the mounting cavity, and a third sub-groove disposed to a rear wall of the mounting cavity, the third sub-groove having a first end connected with an end of the first sub-groove and a second end connected with an end of the second sub-groove, in which the vertical groove is disposed in the rear wall of the mounting cavity, and the vertical groove intersects with the third sub-groove to form a cross; the horizontal convex rib includes a first convex sub-rib disposed to a first side face of the electrical damper and fitted in the first sub-groove, a second convex sub-rib disposed to a second side face of the electrical damper and fitted in the second sub-groove, and a third convex sub-rib disposed to a rear surface of the electrical damper and fitted in the third sub-groove, the third convex sub-rib having a first end connected with an end of the first convex sub-rib and a second end connected with an end of the second convex sub-rib, in which the vertical convex rib is disposed to the rear surface of the electrical damper and the vertical convex rib intersects with the third convex sub-rib to form a cross.

According to an embodiment of the present disclosure, a top wall of the mounting cavity is provided with an upper groove, a bottom wall of the mounting cavity is provided with a lower groove, an upper surface of the electrical damper is provided with an upper convex rib, and a lower surface of the electrical damper is provided with a lower convex rib, in which the vertical groove has an upper end connected with a rear end of the upper groove and a lower end connected with a rear end of the lower groove, the vertical convex rib has an upper end connected with a rear end of the upper convex rib and a lower end connected with a rear end of the lower convex rib, at least a part of the upper convex rib is disposed in the upper groove, and at least a part of the lower convex rib is disposed in the lower groove.

According to an embodiment of the present disclosure, the electrical damper includes: a body, the body having a cavity therein, and a bottom wall of the cavity being provided with the cold air inlet; and a separating member disposed in the cavity, the separating member dividing the cavity into a first sub-cavity and a second sub-cavity and dividing the cold air inlet into a first cold air sub-inlet communicated with the first sub-cavity and a second cold air sub-inlet communicated with the second sub-cavity, in which a top wall of the first sub-cavity is provided with a first cold air outlet, and a top wall of the second sub-cavity is provided with a second cold air outlet.

According to an embodiment of the present disclosure, the air-cooled refrigerator further includes an annular sponge piece, the sponge piece being disposed to a front surface and/or an outer circumferential surface of the electrical damper, the sponge piece abutting against the foaming layer.

According to an embodiment of the present disclosure, a front part of the outer circumferential surface of the electrical damper and/or the front surface of the electrical damper are provided with an annular flange, and the sponge piece is disposed to the flange.

DETAILED DESCRIPTION

Figure 1:
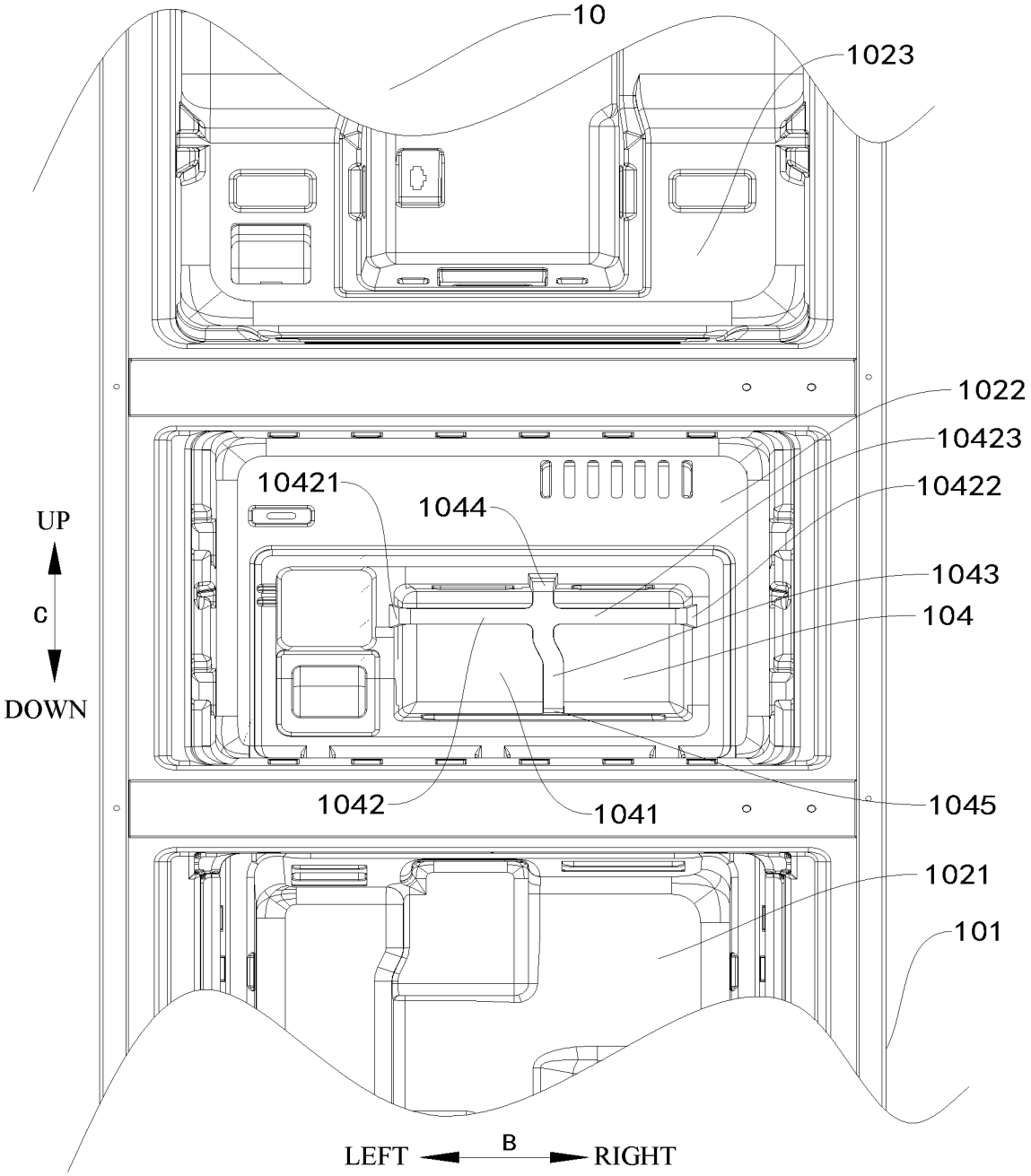
FIG. 1 is a partial schematic view of an air-cooled refrigerator according to embodiments of the present disclosure.

Embodiments of the present disclosure will be described in detail in the following. Examples of the embodiments are illustrated in the drawings. The embodiments described herein with reference to drawings are explanatory, which are intended to explain the present disclosure, and shall not be construed to limit the present disclosure.

The present disclosure is made based on discoveries and acknowledges of the following facts and problems by inventors: a dual electrical damper of an existing three-door air-cooled refrigerator, i.e. an air-cooled refrigerator having a freezing compartment, a refrigerating compartment and a temperature-variable compartment, tends to be involved in a control failure, causing the refrigerating compartment and the temperature-variable compartment to be unable to perform refrigeration. It is found after in-depth research by the inventors that, because the dual electrical damper is mounted in the freezing compartment and temperature in the freezing compartment is relatively low, the dual electrical damper tends to frost and ice up, thereby leading the dual electrical damper to a control failure much easily.

An air-cooled refrigerator 10 according to embodiments of the present disclosure will be described with reference to the drawings in the following. As shown in FIGS. 1-4, the air-cooled refrigerator 10 according to embodiments of the present disclosure includes a housing 101, a freezing inner container 1021, a temperature-variable inner container 1022, a refrigerating inner container 1023, a foaming layer 103, an embedded member 104, an electrical damper 105, a freezing air-outlet passage 1061, a temperature-variable air-inlet passage 1062, and a refrigerating air-inlet passage (not shown in the drawings).

The freezing inner container 1021, the temperature-variable inner container 1022 and the refrigerating inner container 1023 are disposed in the housing 101 at intervals in an up and down direction, a wall of the temperature-variable inner container 1022 is provided with a temperature-variable air inlet, a wall of the refrigerating inner container 1023 is provided with a refrigerating air inlet, and a wall of the freezing inner container 1021 is provided with an air outlet. The foaming layer 103 is filled in a space between the housing 101 and the freezing inner container 1021, the temperature-variable inner container 1022 and the refrigerating inner container 1023. The embedded member 104 is disposed in the foaming layer 103, the electrical damper 105 is provided to the embedded member 104, the electrical damper 105 is located in the foaming layer 103, the electrical damper 105 is provided with a cold air inlet (not shown in the drawings) and a first cold air outlet 1053 and a second cold air outlet 1054 in communication with the cold air inlet. In other words, the electrical damper 105 is a dual electrical damper.

A first end of the freezing air-outlet passage 1061 is connected with the air outlet of the freezing inner container 1021, and a second end of the freezing air-outlet passage 1061 is connected with the cold air inlet of the electrical damper 105. A first end of the temperature-variable air-inlet passage 1062 is connected with the first cold air outlet 1053, and a second end of the temperature-variable air-inlet passage 1062 is connected with the temperature-variable air inlet of the temperature-variable inner container 1022. A first end of the refrigerating air-inlet passage is connected with the second cold air outlet 1054, and a second end of the refrigerating air-inlet passage is connected with the refrigerating air inlet of the refrigerating inner container 1023.

In the air-cooled refrigerator 10 according to embodiments of the present disclosure, by mounting the electrical damper 105 to the embedded member 104 located in the foaming layer 103, the electrical damper 105 can be mounted in the foaming layer 103, therefore it is possible to prevent the electrical damper 105 from being in a low temperature environment, thereby avoiding the electrical damper 105 from being involved in a control failure due to frosting and icing, so as to effectively perform refrigeration in a space of the temperature-variable inner container 1022 and the refrigerating inner container 1023, i.e., effectively performing refrigeration in the refrigerating compartment and the temperature-variable compartment.

Moreover, since the electrical damper 105 is no longer mounted in the freezing inner container 1021, i.e., the electrical damper 105 is no longer mounted in the freezing compartment, a storage space in the freezing inner container 1021 can be increased. Furthermore, the electrical damper 105 is mounted in the embedded member 104, such that the electrical damper 105 can be mounted more easily and steadily.

Therefore, the electrical damper 105 of the air-cooled refrigerator 10 according to embodiments of the present disclosure doesn't tend to be involved in the control failure, and the air-cooled refrigerator 10 has advantages of a large storage space, a reasonable structure and the like.

In one embodiment, the refrigerating inner container 1023 can be provided with a refrigerating return air inlet, the temperature-variable inner container 1022 can be provided with a temperature-variable return air inlet, and the freezing inner container 1021 can be provided with a freezing return air inlet in communication with the refrigerating return air inlet and the temperature-variable return air inlet. These structures can be known and can be independent from inventive concepts of the present disclosure, and thus will not be elaborated.

As shown in FIGS. 1-4, in some embodiments of the present disclosure, the air-cooled refrigerator 10 includes the housing 101, the freezing inner container 1021, the temperature-variable inner container 1022, the refrigerating inner container 1023, the foaming layer 103, the embedded member 104, the electrical damper 105, the freezing air-outlet passage 1061, the temperature-variable air-inlet passage 1062, and the refrigerating air-inlet passage (not shown in the drawings).

The temperature-variable inner container 1022 is disposed above the freezing inner container 1021, and the refrigerating inner container 1023 is disposed above the temperature-variable inner container 1022. The freezing inner container 1021 has the freezing compartment therein, the temperature-variable inner container 1022 has the temperature-variable compartment therein, and the refrigerating inner container 1023 has the refrigerating compartment therein. The up and down direction is shown by an arrow C in FIG. 1.

The foaming layer 103 is filled in the space between the housing 101 and the freezing inner container 1021, the temperature-variable inner container 1022 and the refrigerating inner container 1023. The embedded member 104 is disposed in the foaming layer 103, the electrical damper 105 is provided to the embedded member 104, and that is, the electrical damper 105 is also disposed in the foaming layer 103.

Figure 3:
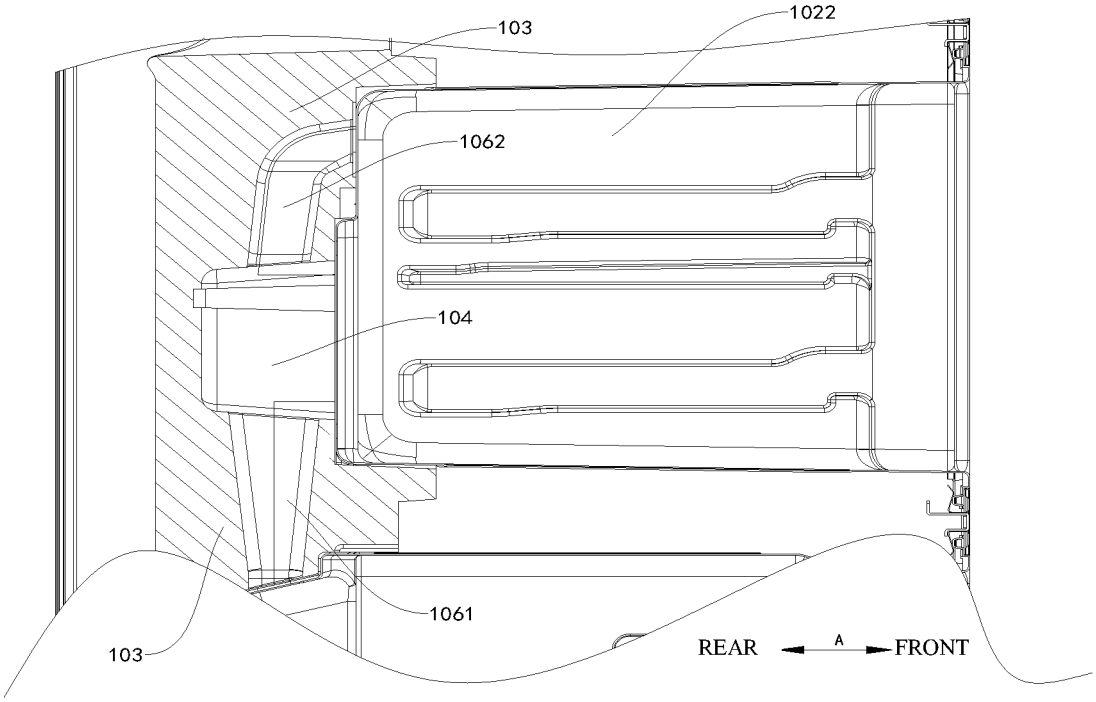
FIG. 3 is a partial sectional view of an air-cooled refrigerator according to embodiments of the present disclosure.
Figure 4:
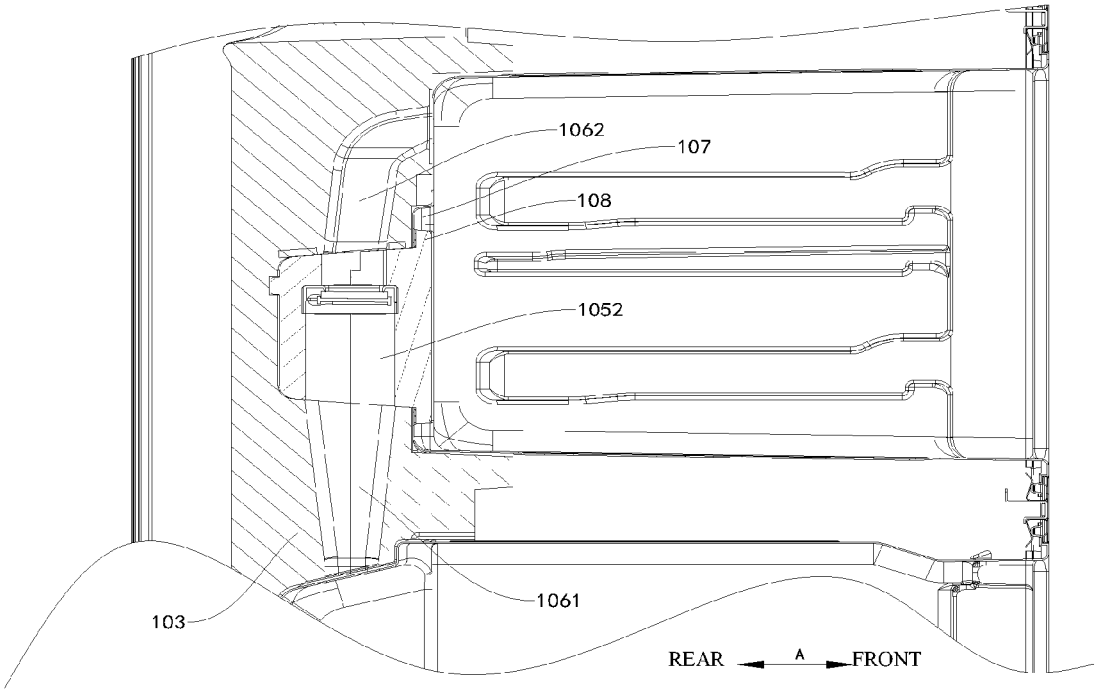
FIG. 4 is a partial sectional view of an air-cooled refrigerator according to embodiments of the present disclosure.

As shown in FIGS. 3 and 4, in an embodiment of the present disclosure, the embedded member 104 and the electrical damper 105 are opposite to the temperature-variable inner container 1022 or the refrigerating inner container 1023 in a horizontal direction. Thus it is possible to further prevent the electrical damper 105 from being in the low temperature environment, thereby further avoiding the electrical damper 105 from being involved in the control failure due to frosting and icing, so as to more effectively perform refrigeration in the space of the temperature-variable inner container 1022 and the refrigerating inner container 1023, i.e., effectively performing refrigeration in the refrigerating compartment and the temperature-variable compartment.

In one embodiment, the embedded member 104 and the electrical damper 105 are opposite to the temperature-variable inner container 1022 in the horizontal direction. Since the temperature-variable inner container 1022 is located below the refrigerating inner container 1023, by allowing the electrical damper 105 to be opposite to the temperature-variable inner container 1022 in the horizontal direction, the cold air flowing away from the freezing inner container 1021 can be allowed to just flow in a single direction from down to up.

In another embodiment, the embedded member 104 and the electrical damper 105 are disposed at rear of the temperature-variable inner container 1022, a rear direction can be a direction away from a user, and a front direction can be a direction adjacent to the user, front and rear directions are shown by an arrow A in FIGS. 3 and 4.

Figure 2:
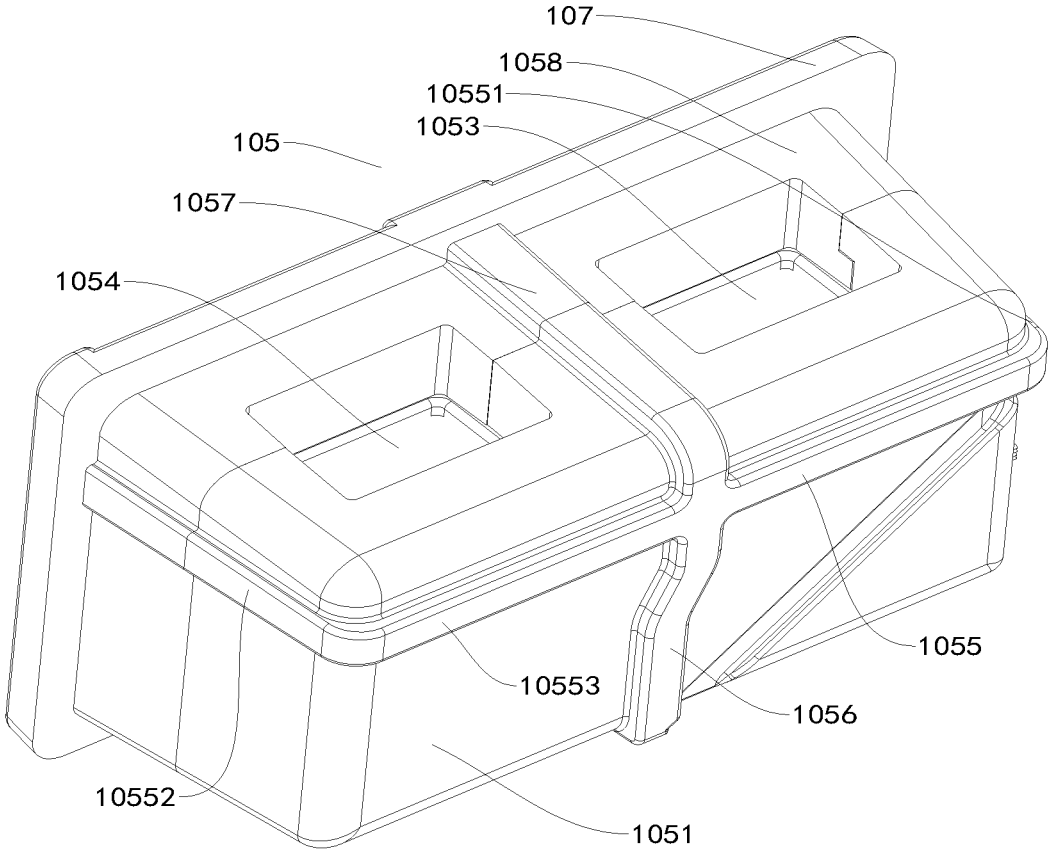
FIG. 2 is a schematic view of an electrical damper of an air-cooled refrigerator according to embodiments of the present disclosure.

As shown in FIG. 2, in some examples of the present disclosure, the electrical damper 105 includes a body 1051 and a separating member (not shown in the drawings). The body 1051 has a cavity 1052 therein, and a bottom wall of the cavity 1052 is provided with the cold air inlet. The separating member is disposed in the cavity 1052, and the separating member divides the cavity 1052 into a first sub-cavity and a second sub-cavity and divides the cold air inlet into a first cold air sub-inlet communicated with the first sub-cavity and a second cold air sub-inlet communicated with the second sub-cavity. A top wall of the first sub-cavity is provided with a first cold air outlet 1053, and a top wall of the second sub-cavity is provided with a second cold air outlet 1054.

In other words, the cold air entering the cavity 1052 of the electrical damper 105 through the cold air inlet is divided into two parts by the separating member, a first part flows in the first sub-cavity and enters the temperature-variable air-inlet passage 1062 through the first cold air outlet 1053, and a second part flows in the second sub-cavity and enters the refrigerating air-inlet passage through the second cold air outlet 1054, thus allowing the structure of the electrical damper 105 to be more reasonable.

As shown in FIG. 1, the embedded member 104 has a mounting cavity 1041 having an open end, and at least a part of the electrical damper 105 is disposed in the mounting cavity 1041, thus allowing the structure of the air-cooled refrigerator 10 to be more reasonable. Specifically, a front end of the mounting cavity 1041 is open.

Since at least the part of the electrical damper 105 is disposed in the mounting cavity 1041, the second end of the freezing air-outlet passage 1061 is connected with the cold air inlet of the electrical damper 105 by penetrating the embedded member 104 or through a through hole in the embedded member 104, the first end of the temperature-variable air-inlet passage 1062 is connected with the first cold air outlet 1053 by penetrating the embedded member 104 or through the through hole in the embedded member 104, and the first end of the refrigerating air-inlet passage is connected with the second cold air outlet 1054 by penetrating the embedded member 104 or through the through hole in the embedded member 104.

In related art, in order to prevent air leakage, the air inlet and air outlet of the electrical damper are sealed by a sponge, that is, the sponge is pasted at the air inlet and air outlet of the electrical damper. However, the fact that the air inlet and air outlet of the electrical damper are sealed by the sponge enables the assembly processing to be complicated and increases the assembly difficulty, moreover, the sponge tends to curl up, influencing the sealing effect. Specifically, in the air-cooled refrigerator 10 according to embodiments of the present disclosure, since at least the part of the electrical damper 105 is disposed in the embedded member 104, that is, the cold air inlet, the first cold air outlet 1053 and the second cold air outlet 1054 of the electrical damper 105 are located in the mounting cavity 1041 of the embedded member 104, if the sponge is pasted at the cold air inlet, the first cold air outlet 1053 and the second cold air outlet 1054 of the electrical damper 105, the sponge may penetrate the embedded member 104, which further increases the assembly difficulty, enables the assembly processing to be more complicated and the sponge to curl up more easily.

In an example of the present disclosure, as shown in FIGS. 1-4, a wall of the mounting cavity 1041 is provided with a horizontal groove 1042 and a vertical groove 1043, and an outer surface of the electrical damper 105 is provided with a horizontal convex rib 1055 and a vertical convex rib 1056. At least a part of the horizontal convex rib 1055 is disposed in the horizontal groove 1042, and at least a part of the vertical convex rib 1056 is disposed in the vertical groove 1043.

Thus the electrical damper 105 can be mounted in the mounting cavity 1041 of the embedded member 104 more conveniently and steadily, moreover, by fitting the horizontal convex rib 1055 to the horizontal groove 1042, the cold air output from the freezing inner container 1021 can be prevented from leaking in the up and down direction, and by fitting the vertical convex rib 1056 into the vertical groove 1043, the cold air output from the freezing inner container 1021 can be prevented from leaking in a left and right direction. That is, for the air-cooled refrigerator 10 according to embodiments of the present disclosure, it is not necessary to paste the sponge at the cold air inlet, the first cold air outlet 1053 and the second cold air outlet 1054 of the electrical damper 105, thereby simplifying the assembly processing, reducing the assembly difficulty and improving the sealing effect.

In one embodiment, a shape of the horizontal convex rib 1055 is adapted to a shape of the horizontal groove 1042, and a shape of the vertical convex rib 1056 is adapted to a shape of the vertical groove 1043. Thus, the electrical damper 105 can be mounted in the mounting cavity 1041 of the embedded member 104 more conveniently and steadily, moreover, the sealing effect for the electrical damper 105 can be further improved.

As shown in FIGS. 1-4, in a specific example of the present disclosure, the horizontal groove 1042 includes a first sub-groove 10421 disposed to a first side wall (e.g. a left side wall) of the mounting cavity 1041, a second sub-groove 10422 disposed to a second side wall (e.g. a right side wall) of the mounting cavity 1041, and a third sub-groove 10423 disposed to a rear wall of the mounting cavity 1041. A first end (e.g. a left end) of the third sub-groove 10423 is connected with an end (e.g. a rear end) of the first sub-groove 10421, and a second end (e.g. a right end) of the third sub-groove 10423 is connected with an end (e.g. a rear end) of the second sub-groove 10422. The vertical groove 1043 is disposed in the rear wall of the mounting cavity 1041, and the vertical groove 1043 intersects with the third sub-groove 10423 to form a cross.

The horizontal convex rib 1055 includes a first convex sub-rib 10551 disposed to a first side face (e.g. a left side face) of the electrical damper 105 and fitted in the first sub-groove 10421, a second convex sub-rib 10552 disposed to a second side face (e.g. a right side face) of the electrical damper 105 and fitted in the second sub-groove 10422, and a third convex sub-rib 10553 disposed to a rear surface of the electrical damper 105 and fitted in the third sub-groove 10423. A first end (e.g. a left end) of the third convex sub-rib 10553 is connected with an end (e.g. a rear end) of the first convex sub-rib 10551, and a second end (e.g. a right end) of the third convex sub-rib 10553 is connected with an end (e.g. a rear end) of the second convex sub-rib 10552. The vertical convex rib 1056 is disposed to the rear surface of the electrical damper 105 and the vertical convex rib 1056 intersects with the third convex sub-rib 10553 to form a cross.

Thus, the electrical damper 105 can be mounted in the mounting cavity 1041 of the embedded member 104 more conveniently and steadily, moreover, the sealing effect for the electrical damper 105 can be further improved. The left and right direction is shown by an arrow B in FIG. 1.

In one embodiment, a top wall of the mounting cavity 1041 is provided with an upper groove 1044, a bottom wall of the mounting cavity 1041 is provided with a lower groove 1045, an upper surface of the electrical damper 105 is provided with an upper convex rib 1057, and a lower surface of the electrical damper 105 is provided with a lower convex rib (not shown in the drawings). An upper end of the vertical groove 1043 is connected with a rear end of the upper groove 1044, and a lower end of the vertical groove 1043 is connected with a rear end of the lower groove 1045, an upper end of the vertical convex rib 1056 is connected with a rear end of the upper convex rib 1057 and a lower end of the vertical convex rib 1056 is connected with a rear end of the lower convex rib. At least a part of the upper convex rib 1057 is disposed in the upper groove 1044, and at least a part of the lower convex rib is disposed in the lower groove 1045. Thus the electrical damper 105 can be mounted in the mounting cavity 1041 of the embedded member 104 more conveniently and steadily, moreover, the cold air output from the freezing inner container 1021 can be further prevented from leaking in the left and right direction.

As shown in FIGS. 2 and 4, the air-cooled refrigerator 10 further includes an annular sponge piece 107, the sponge piece 107 is disposed to a front surface and/or an outer circumferential surface 1058 of the electrical damper 105, and the sponge piece 107 abuts against the foaming layer 103. In other words, the sponge piece 107 can be disposed to the front surface of the electrical damper 105, can also be disposed to the outer circumferential surface 1058 of the electrical damper 105, and can further be disposed to both of the front surface and the outer circumferential surface 1058 of the electrical damper 105. Thus, the sealing effect for the electrical damper 105 can further be improved.

In one embodiment, a front part of the outer circumferential surface 1058 of the electrical damper 105 and/or the front surface of the electrical damper 105 are (is) provided with an annular flange 108, and the sponge piece 107 is disposed to the flange 108. That is, the flange 108 can be disposed to the front surface of the electrical damper 105, can also be disposed to the outer circumferential surface 1058 of the electrical damper 105, and can further be disposed to both of the front surface of the electrical damper 105 and the outer circumferential surface 1058 of the electrical damper 105. Thus, the sponge piece 107 can be mounted more conveniently and steadily.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "axial," "radial," "circumferential direction," "clockwise," and "counterclockwise" should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, the above embodiments should not be construed to limit the present disclosure, and changes, alternatives, and modifications can be made in the embodiments without departing from the scope of the present disclosure.

What is claimed is:

1. An air-cooled refrigerator, comprising:

a housing;

a freezing inner container, a temperature-variable inner container and a refrigerating inner container disposed in the housing at intervals in an up and down direction, wherein a wall of the temperature-variable inner container is provided with a temperature-variable air inlet, a wall of the refrigerating inner container is provided with a refrigerating air inlet, and a wall of the freezing inner container is provided with an air outlet;

a foaming layer filled in a space between the housing and the freezing inner container, the temperature-variable inner container and the refrigerating inner container;

an embedded member disposed in the foaming layer;

an electrical damper provided to the embedded member and located in the foaming layer, the electrical damper being provided with a cold air inlet and a first cold air outlet and a second cold air outlet in communication with the cold air inlet;

a freezing air-outlet passage having a first end connected with the air outlet and a second end connected with the cold air inlet; and a temperature-variable air-inlet passage and a refrigerating air-inlet passage, the temperature-variable air-inlet passage having a first end connected with the first cold air outlet and a second end connected with the temperature-variable air inlet, the refrigerating air-inlet passage having a first end connected with the second cold air outlet and a second end connected with the refrigerating air inlet;

wherein the embedded member has a mounting cavity, the mounting cavity having an open end, and at least a part of the electrical damper is disposed in the mounting cavity;

wherein a wall of the mounting cavity is provided with a horizontal groove and a vertical groove, and an outer surface of the electrical damper is provided with a horizontal convex rib and a vertical convex rib, wherein at least a part of the horizontal convex rib is disposed in the horizontal groove, and at least a part of the vertical convex rib is disposed in the vertical groove;

wherein a shape of the horizontal convex rib is adapted to a shape of the horizontal groove, and a shape of the vertical convex rib is adapted to a shape of the vertical groove;

wherein the horizontal groove comprises a first sub-groove disposed to a first side wall of the mounting cavity, a second sub-groove disposed to a second side wall of the mounting cavity, and a third sub-groove disposed to a rear wall of the mounting cavity, the third sub-groove having a first end connected with an end of the first sub-groove and a second end connected with an end of the second sub-groove, wherein the vertical groove is disposed in the rear wall of the mounting cavity, and the vertical groove intersects with the third sub-groove to form a cross; and the horizontal convex rib comprises a first convex sub-rib disposed to a first side face of the electrical damper and fitted in the first sub-groove, a second convex sub-rib disposed to a second side face of the electrical damper and fitted in the second sub-groove, and a third convex sub-rib disposed to a rear surface of the electrical damper and fitted in the third sub-groove, the third convex sub-rib having a first end connected with an end of the first convex sub-rib and a second end connected with an end of the second convex sub-rib, wherein the vertical convex rib is disposed to the rear surface of the electrical damper and the vertical convex rib intersects with the third convex sub-rib to form a cross.

2. The air-cooled refrigerator according to claim 1, wherein the embedded member and the electrical damper are opposite to the temperature-variable inner container or the refrigerating inner container in a horizontal direction.

3. The air-cooled refrigerator according to claim 1, wherein a top wall of the mounting cavity is provided with an upper groove, a bottom wall of the mounting cavity is provided with a lower groove, an upper surface of the electrical damper is provided with an upper convex rib, and a lower surface of the electrical damper is provided with a lower convex rib, wherein the vertical groove has an upper end connected with a rear end of the upper groove and a lower end connected with a rear end of the lower groove, the vertical convex rib has an upper end connected with a rear end of the upper convex rib and a lower end connected with a rear end of the lower convex rib, at least a part of the upper convex rib is disposed in the upper groove, and at least a part of the lower convex rib is disposed in the lower groove.

4. The air-cooled refrigerator according to claim 1, wherein the electrical damper comprises:

a body, the body having a cavity therein, and a bottom wall of the cavity being provided with the cold air inlet; and a separating member disposed in the cavity, the separating member dividing the cavity into a first sub-cavity and a second sub-cavity and dividing the cold air inlet into a first cold air sub-inlet communicated with the first sub-cavity and a second cold air sub-inlet communicated with the second sub-cavity, wherein a top wall of the first sub-cavity is provided with a first cold air outlet, and a top wall of the second sub-cavity is provided with a second cold air outlet.

5. The air-cooled refrigerator according to claim 1, wherein the air-cooled refrigerator further comprises an annular sponge piece, the sponge piece being disposed to a front surface and/or an outer circumferential surface of the electrical damper, the sponge piece abutting against the foaming layer.

6. The air-cooled refrigerator according to claim 5, wherein a front part of the outer circumferential surface of the electrical damper and/or the front surface of the electrical damper are provided with an annular flange, and the sponge piece is disposed to the flange.

* * * * *